US008491337B2

(12) United States Patent
Cai

(10) Patent No.: US 8,491,337 B2
(45) Date of Patent: Jul. 23, 2013

(54) ELECTRICAL CONNECTOR WITH SHIELDED RECESSED PORTIONS

(75) Inventor: You Hua Cai, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 202 days.

(21) Appl. No.: 13/190,357

(22) Filed: Jul. 25, 2011

(65) Prior Publication Data

US 2012/0238137 A1 Sep. 20, 2012

(30) Foreign Application Priority Data

Mar. 14, 2011 (CN) ..... 2011 2 0066487 U

(51) Int. Cl.
*H01R 13/648* (2006.01)

(52) U.S. Cl.
USPC ..... 439/607.28; 439/66

(58) Field of Classification Search
USPC ..... 439/607.28, 66, 626, 92, 607.02, 439/607.03, 342, 83, 862, 733.1
See application file for complete search history.

(56) References Cited

U.S. PATENT DOCUMENTS

| | | | | |
|---|---|---|---|---|
| 6,425,771 | B1 * | 7/2002 | Shirai et al. | 439/83 |
| 6,699,055 | B2 * | 3/2004 | Peng et al. | 439/342 |
| 7,001,198 | B2 * | 2/2006 | He et al. | 439/342 |
| 7,717,760 | B2 * | 5/2010 | Ma | 439/862 |
| 8,147,256 | B2 * | 4/2012 | Jin | 439/83 |
| 8,192,206 | B1 * | 6/2012 | Ju | 439/66 |
| 2012/0171897 | A1 * | 7/2012 | Ju et al. | 439/607.01 |
| 2012/0178298 | A1 * | 7/2012 | Jin | 439/626 |
| 2012/0196481 | A1 * | 8/2012 | Ju | 439/626 |

* cited by examiner

*Primary Examiner* — Hae Moon Hyeon
(74) *Attorney, Agent, or Firm* — Morris Manning & Martin LLP; Tim Tingkang Xia, Esq.

(57) ABSTRACT

An electrical connector includes: an insulating body, having a plurality of terminal slots formed through the insulating body; a plurality of terminals, each correspondingly received in each terminal slot; and at least one recessed portion, recessed on the insulating body and located between at least two terminals, and plated with a metal shielding layer. As the recessed portion is recessed between at least two terminals, the air medium capacity can be adjusted by adjusting the size of the recessed portion, so as to adjust the characteristic impedance between the adjacent terminals to a desired value, thereby improving the high-frequency performance of the electrical connector. Furthermore, the recessed portion is plated with the metal shielding layer, so that the terminals are shielded and prevented from getting in contact with the metal shielding layer, thus avoiding the problem of short circuit.

12 Claims, 6 Drawing Sheets

ELECTRICAL CONNECTOR WITH SHIELDED RECESSED PORTIONS

CROSS-REFERENCE TO RELATED APPLICATIONS

This non-provisional application claims priority under 35 U.S.C. §119(a) on Patent Application No. 201120066487.5 filed in China on Mar. 14, 2011, the entire contents of which are hereby incorporated by reference.

FIELD OF THE INVENTION

The present invention relates to an electrical connector, and more particularly to an electrical connector for electrically connecting a chip module to a circuit board.

BACKGROUND OF THE INVENTION

Along with the development of science and technology, the terminals are disposed in the electrical connector more densely, and transmit signals at higher frequencies, so a series of problems arise in the use of the electrical connector, which mainly include interference of signal transmission between the terminals and small characteristic impedance between adjacent terminals. Consequently, the high-frequency performance of the electrical connector is unsatisfactory, and the high-frequency signal transmission of the terminals is stable and will not be distorted only at proper large characteristic impedance.

Currently, an electrical connector for electrically connecting a chip module to a circuit board in this field includes an insulating body, a plurality of terminal slots formed through the insulating body, a metal shielding layer plated on an inner wall of each terminal slot, an insulating layer coated on the metal shielding layer, a plurality of terminals respectively correspondingly received in the terminal slots, and a grounding member for conducting the metal shielding layer to ground.

Obviously, in the electrical connector of the related art, as the metal shielding layer is plated on the inner wall of the terminal slot, the problem of the signal transmission interference between the terminals is solved. However, the metal shielding layer is isolated from the terminal merely by the thin insulating layer, so that when the terminal is inserted into the terminal slot, as the fit dimensions of the terminal and the terminal slot are not consistent and a positioning error between the terminals exists, the terminal penetrates the insulating layer to get in contact with the metal layer, thus causing a short circuit problem.

Furthermore, no structure is configured between adjacent terminal slots to improve the characteristic impedance of the terminals, so that the high-frequency performance of the electrical connector is unsatisfactory.

Therefore, a heretofore unaddressed need exists in the art to address the aforementioned deficiencies and inadequacies.

SUMMARY OF THE INVENTION

In one aspect, the present invention is directed to an electrical connector, which has a good high-frequency performance and can avoid the short circuit problem.

In one embodiment, the present invention provides an electrical connector. The electrical connector includes: an insulating body, having a plurality of terminal slots formed through the insulating body; a plurality of terminals, each correspondingly received in each terminal slot; and at least one recessed portion, recessed on the insulating body and located between at least two terminals, and plated with a metal shielding layer.

As compared with the prior art, the recessed portion is recessed between the terminals, so that an air medium (the dielectric coefficient of the air medium is the smallest) capacity between the terminals can be controlled by adjusting the size of the recessed portion. As the capacitance is in direct proportion to the dielectric coefficient, the capacitance of the terminals can be adjusted by adjusting the air medium capacity between the terminals. As the characteristic impedance increases as the capacitance between the adjacent terminals decreases, the capacitance of the terminals can be adjusted to a proper small value by adjusting the air medium capacity between the terminals, so that the characteristic impedance reaches a proper large value, thereby preventing the distortion of the high-frequency signal transmission of the terminals and achieving a good high-frequency performance of the electrical connector.

Furthermore, the metal shielding layer is disposed on an inner wall of the recessed portion, so the terminals are prevented from getting in contact with the metal shielding layer, thus avoiding the problem of short circuit.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
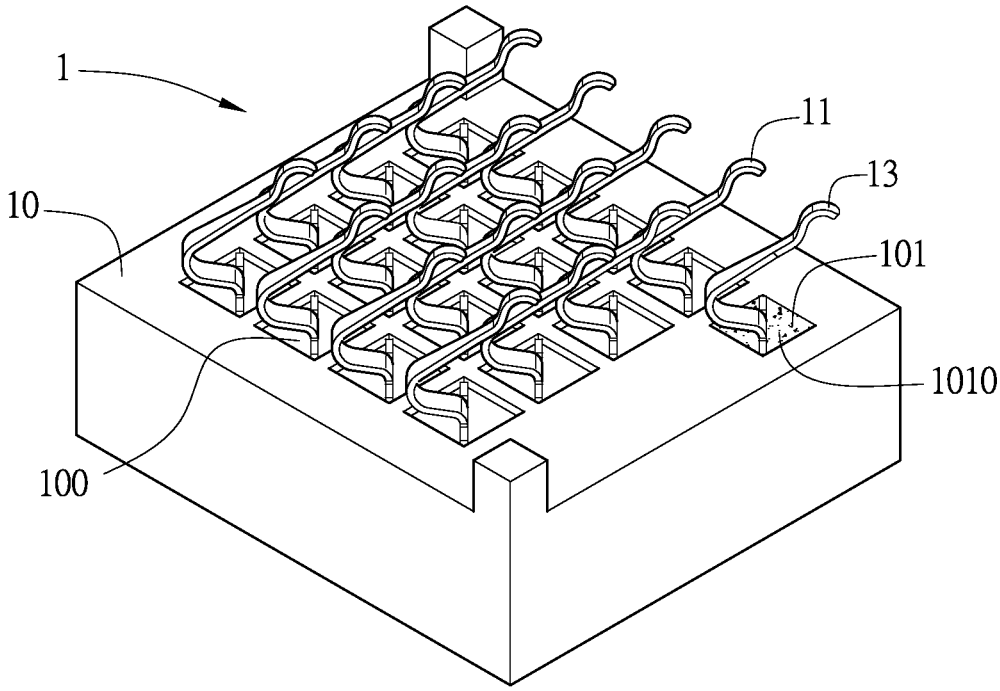
FIG. 1 is a three-dimensional view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

FIGS. 1-4 are schematic views of an electrical connector according to a first embodiment of the present invention.

Figure 2:
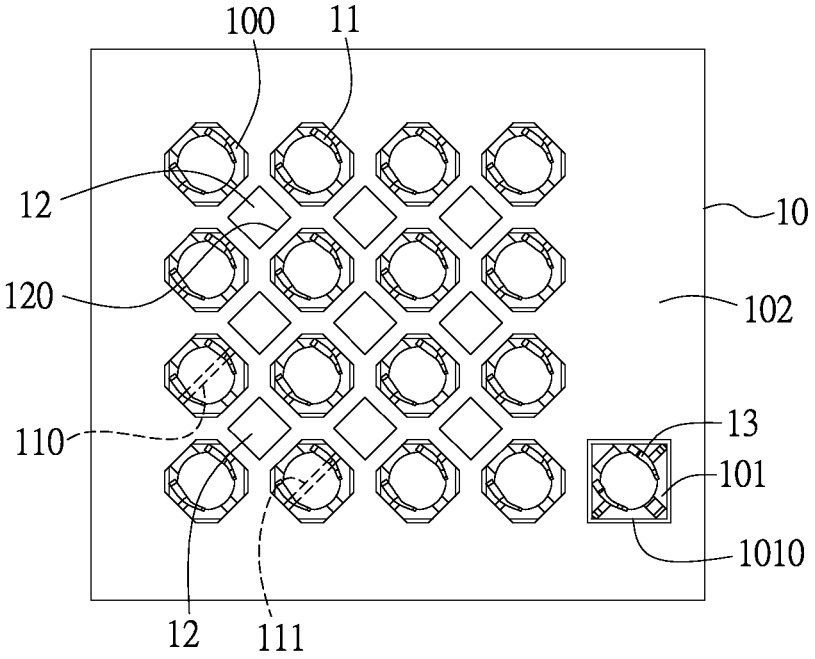
FIG. 2 is a bottom view of the electrical connector according to the first embodiment of the present invention.

Referring to FIG. 1 and FIG. 2, the electrical connector 1 of the present invention electrically conducts a chip module 2 to a circuit board 3. The electrical connector 1 includes an insulating body 10, a plurality of terminals 11 received in the insulating body 10, at least one recessed portion 12 recessed on the insulating body 10 and located between at least two terminals 11, a grounding terminal 13 accommodated in the insulating body 10 and a plurality of solder balls 14 respectively corresponding to the terminals 11 and the grounding terminal 13.

Figure 3:
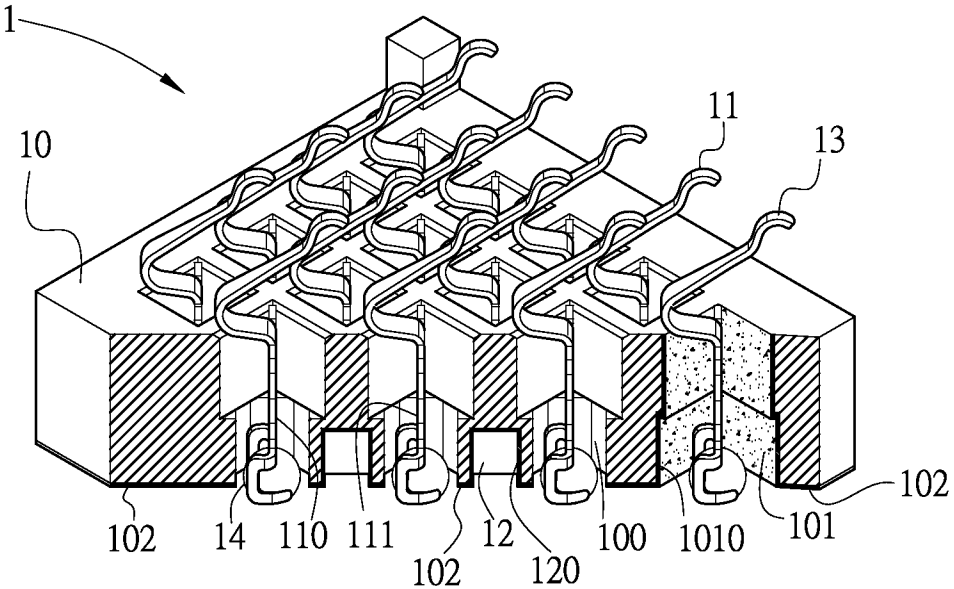
FIG. 3 is a schematic three-dimensional sectional view of the electrical connector according to the first embodiment of the present invention.

Referring to FIG. 3, the insulating body 10 is formed by injection molding and includes a plurality of terminal slots 100 formed through the insulating body 10 and a receiving hole 101. The terminal slots 100 are arranged in matrix, and a metal layer 1010 is plated in the receiving hole 101 and is electrically conducted to the grounding terminal 13, and a metal conductive layer 102 is plated on a bottom surface of the insulating body 10 and is electrically conducted to the metal layer 1010.

Referring to FIG. 3, the terminals 11 are formed by punching, and each terminal 11 includes a terminal outer surface 110 and a terminal inner surface 111. As the terminal outer surface 110 and the terminal inner surface 111 are the two largest surfaces of the terminal 11, a relative area between the terminal outer surface 110 and the terminal inner surface 111 opposite to each other of the adjacent terminals 11 is the largest. That is, the recessed portion 12 is located between the outer surface 110 and the inner surface 111 opposite to each other of the adjacent terminals 11. Each terminal 11 is corresponding to each terminal slot 100, so the terminals 11 are also arranged in matrix. The terminals 11 electrically conduct the chip module 2 to the circuit board 3, thereby realizing a signal transmission function.

Referring to FIG. 3, a plurality of recessed portions 12 is provided. The recessed portions 12 are rectangular holes and recessed from the bottom surface of the insulating body 10. Each recessed portion 12 is surrounded by four terminal slots 100, and each terminal 11 located in the matrix but not on the edge of the matrix is surrounded by four recessed portions 12. Each recessed portion 12 is located between the adjacent terminals 11 with the largest opposite area. The depth of the recessed portions 12 varies depending upon different situations. In certain embodiments, the recessed portions 12 may not be formed through the top surface and the bottom surface of the insulating body 10. In other embodiments, referring to FIG. 7, the recessed portions 12 may be formed through the top surface and the bottom surface of the insulating body 10. A metal shielding layer 120 is plated on an inner wall of the recessed portion 12 for shielding the terminal 11, thus preventing the interference, that is, "Cross Talk" during signal transmission of the terminals 11. The metal shielding layer 120 is electrically conducted to the grounding terminal 13 through the metal conductive layer 102 and the metal layer 1010, and thus is grounded through the grounding terminal 13.

In other embodiments (not shown), the recessed portions 12 are recessed from the top surface of the insulating body 10, and may be formed through the bottom surface of the insulating body 10 or not formed through the bottom surface of the insulating body 10. Therefore, the metal conductive layer 102 may also be plated on the top surface of the insulating body 10. If the recessed portions 12 are not formed through the bottom surface of the insulating body 10, each recessed portion 12 may be disposed around a periphery of each terminal slot 100 to substantially form two concentric squares together with the terminal slot 100.

Figure 4:
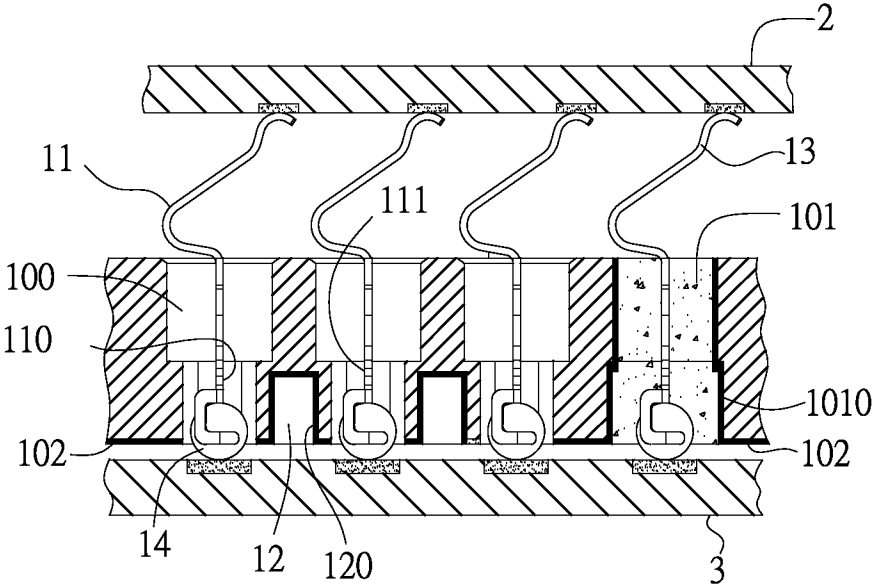
FIG. 4 is a schematic front view of FIG. 3.

Referring to FIG. 3 and FIG. 4, in this embodiment, the shape, dimension and structure of the grounding terminal 13 are identical to those of the terminals 11, so the grounding terminal 13 may be fabricated without using new equipment and process flow, thereby saving the cost. The grounding terminal 13 conducts the chip module 2 and the metal shielding layer 102 to corresponding positions on the circuit board 3 for grounding.

Referring to FIG. 4, the solder balls 14 are respectively corresponding to the terminals 11 and the grounding terminal 13. After soldering (not shown), the terminals 11 and the grounding terminal 13 are bonded to the circuit board 3 through the solder balls 14, so as to realize the electrical connection.

In other embodiments (not shown), the metal shielding layer 120 is not only disposed on the recessed portion 12, but may also be partially disposed in the terminal slot 100, that is, disposed in a region where the terminal slot 100 and the terminal 11 are not in contact, thereby further enhancing the shielding effect for the terminals 11.

Figure 5:
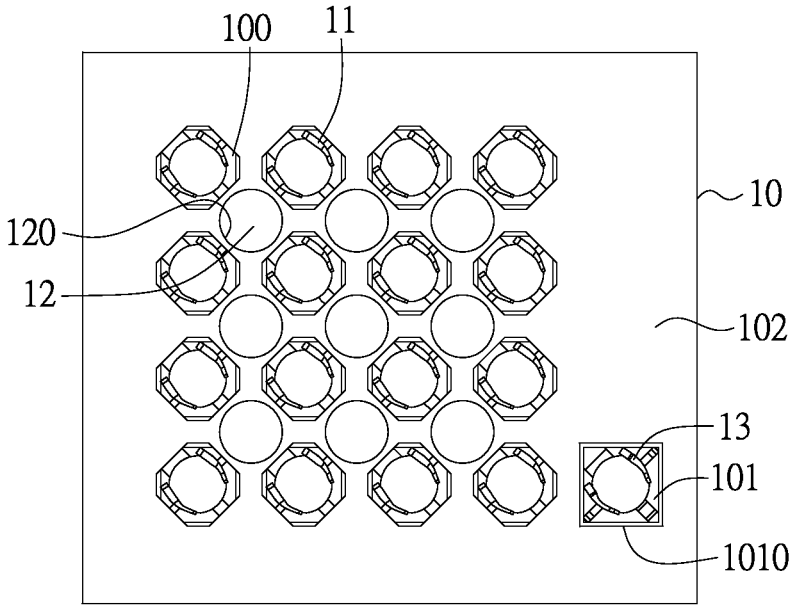
FIG. 5 is a bottom view of an electrical connector according to a second embodiment of the present invention.

FIG. 5 is a bottom view of an electrical connector according to a second embodiment of the present invention, and different from the first embodiment, the recessed portions 12 are round holes.

Figure 6:
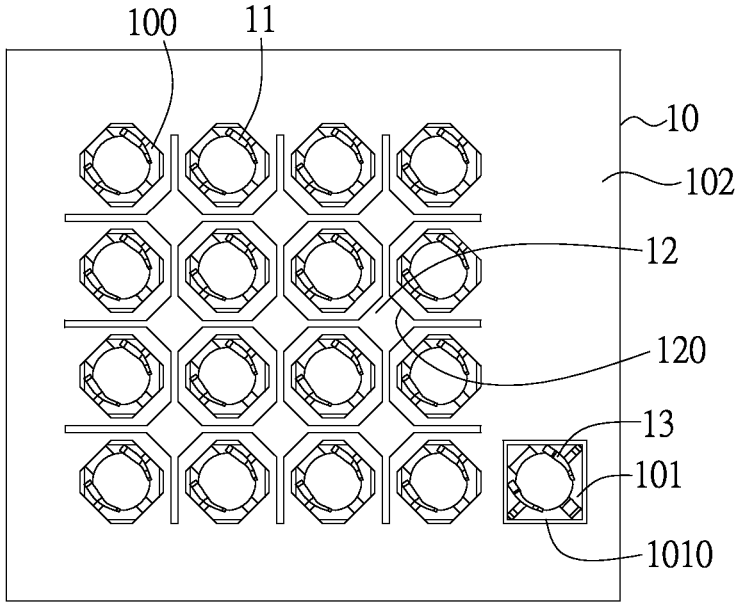
FIG. 6 is a bottom view of an electrical connector according to a third embodiment of the present invention.

FIG. 6 is a bottom view of an electrical connector according to a third embodiment of the present invention, and different from the first embodiment, the recessed portions 12 are not formed through the insulating body 10, and the recessed portions 12 are connected with each other, so that the terminal slot 100 located in the matrix but not on the edge of the matrix is surrounded by the recessed portions 12, and three sides of the terminal slot 100 located on the edge of the matrix are surrounded by the recessed portions 12.

Figure 7:
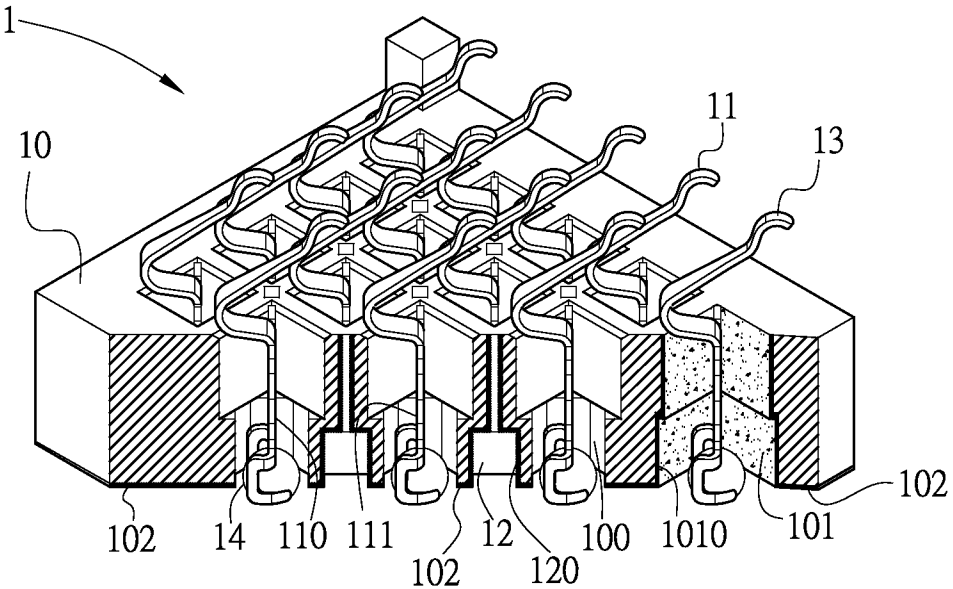
FIG. 7 is a schematic three-dimensional sectional view of the electrical connector according to a fourth embodiment of the present invention.

Referring to FIG. 7, in a fourth embodiment of the present invention, the recessed portions 12 are recessed from the top surface of the insulating body 10, and formed through the bottom surface of the insulating body 10. Therefore, the metal conductive layer 102 may also be plated on the top surface of the insulating body 10.

Based on the above, the electrical connector of the present invention, among other things, has the following beneficial effects.

1. As the characteristic impedance decreases as the capacitance increases, and the capacitance is in direct proportion to the opposite area of the adjacent terminals 11, the terminals 11 with a large opposite area have small characteristic impedance, which needs to be improved. The recessed portions 12 are located between the adjacent terminals 11 with the largest opposite area, which is beneficial to reducing the excess capacitance generated by the terminals 11, thereby adjusting the characteristic impedance of the terminals 11 to a proper large value.

2. The recessed portions 12 are recessed from the bottom surface of the insulating body 10 or formed through the insulating body 10 to the bottom surface, which is beneficial to dissipating heat during soldering, thereby reducing the deformation of the insulating body 10.

3. The metal shielding layer 120 is plated on the inner wall of the recessed portion 12, so the metal shielding layer 120 may shield the terminals 11, thereby preventing the signal interference between the terminals 11 and avoiding the influence on the signal transmission performance.

4. The recessed portion 12 is disposed around the periphery of the terminal slot 100, thereby completely isolating the terminal 11, so the metal shielding layer 120 provides a better shielding effect for the terminal 11 as compared with that obtained when the recessed portion 12 is not disposed around the periphery of the terminal slot 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

(a) an insulating body, having a plurality of terminal slots formed through the insulating body;

(b) a plurality of terminals, each correspondingly received in each terminal slot; and (c) at least one recessed portion, recessed on the insulating body and located between at least two terminals, and plated with a metal shielding layer.

2. The electrical connector according to claim 1, wherein the recessed portion is formed through the insulating body.

3. The electrical connector according to claim 1, wherein the recessed portion is recessed from a bottom surface of the insulating body.

4. The electrical connector according to claim 3, wherein the bottom surface of the insulating body is plated with a metal conductive layer, and the metal conductive layer conducts the metal shielding layer to ground.

5. The electrical connector according to claim 4, further comprising a receiving hole formed through the insulating body and a grounding terminal accommodated in the receiving hole, wherein a metal layer is plated in the receiving hole; and wherein the metal shield layer is in contact with the metal conductive layer, the metal conductive layer is in contact with the metal layer, and the metal layer is in contact with the grounding terminal.

6. The electrical connector according to claim 1, wherein each recessed portion is surrounded by four terminal slots.

7. The electrical connector according to claim 1, wherein at least one terminal is surrounded by four recessed portions.

8. The electrical connector according to claim 1, wherein each recessed portion is disposed around a periphery of each terminal slot.

9. The electrical connector according to claim 1, wherein the at least one recessed portion is formed as a rectangular hole.

10. The electrical connector according to claim 1, wherein the at least one recessed portion is formed as a round hole.

11. The electrical connector according to claim 1, wherein the at least one recessed portion comprises a plurality of recessed portions.

12. The electrical connector according to claim 11, wherein any two neighboring recessed portions of the plurality of recessed portions are connected with each other.

* * * * *